United States Patent [19]

Mayer

[11] 4,318,749

[45] Mar. 9, 1982

[54] WETTABLE CARRIER IN GAS DRYING SYSTEM FOR WAFERS

[75] Inventor: Alfred Mayer, Somerville, N.J.

[73] Assignee: RCA Corporation, New York, N.Y.

[21] Appl. No.: 162,086

[22] Filed: Jun. 23, 1980

[51] Int. Cl.[3] ..... B08B 3/10; B08B 13/00

[52] U.S. Cl. ..... 134/25.4; 134/30; 134/32; 134/37; 211/41; 34/22; 34/34; 34/218; 34/231

[58] Field of Search ..... 134/25.4, 30, 37, 61, 134/63, 124, 32; 34/34, 231, 22, 218; 211/13, 41

[56] References Cited

U.S. PATENT DOCUMENTS

| | | | |
|---|---|---|---|
| 3,534,862 | 10/1970 | Shambelan | 211/41 |
| 3,678,893 | 7/1972 | Bell | 211/41 X |
| 3,826,377 | 7/1974 | Bachmann | 211/41 |
| 3,828,726 | 8/1974 | Dietze et al. | 211/41 X |
| 3,893,869 | 7/1975 | Mayer et al. | 134/86 |
| 3,926,305 | 12/1975 | Wallestad | 211/41 X |

*Primary Examiner*—Richard V. Fisher

*Attorney, Agent, or Firm*—Birgit E. Morris; D. S. Cohen; T. H. Magee

[57] ABSTRACT

A gas drying system for use in removing a liquid from a substrate comprises a carrier adapted to support the substrate wherein the parts of the carrier that make contact with the substrate have a surface wettable by the liquid and the wettable surface has a roughened surface of a material that is capable of being hydroxylated, and a dryer for exposing the substrate to a stream of ambient-temperature gas.

20 Claims, 4 Drawing Figures

COMPARISON OF CLEANING AND DRYING RATES AT VARIOUS BELT SPEEDS

WETTABLE CARRIER IN GAS DRYING SYSTEM FOR WAFERS

This invention deals with a gas drying system for use in removing a liquid from a substrate while being supported in a wafer carrier.

BACKGROUND OF THE INVENTION

Silicon wafers are cleaned by exposure to aqueous chemical solutions prior to each thermal exposure step, i.e., between 8 and 16 times during the fabrication of a typical integrated circuit device. It is customary in the semiconductor industry to dry silicon wafers by spinning them in a centrifuge. This has a number of disadvantages. The material of construction of the carrier cannot be quartz because quartz is not strong enough, and this implies that the wafers must be cleaned and dried in a plastic carrier and then transferred to quartz (which in turn has to be cleaned separately) before annealing, diffusion or oxidation. Another problem is that centrifuging is essentially a batch operation and does not fit in well with continuous processing. Also, the downtime of a centrifuge is relatively great because, like all highly stressed mechanical systems, a centrifuge requires maintenance and, besides, is difficult to clean if it gets contaminated by insertion of an improperly handled, dirty carrier, by the inevitable breakage of a wafer that showers debris, or by particle-laden air being dragged into the chamber.

Another type of drying system in current use relies on a high-speed hot-air dryer to first remove all the large liquid drops of rinse water from the surface, then raise the temperature to about 100° C. to insure complete removal. This takes almost 3 minutes and requires the input of about 6 kW electrical heat for heating the filtered air needed to dry one carrier with twenty-five 76-mm-diameter wafers, plus an airflow of several hundred cubic feet per minute. With the invention of megasonic cleaning (see U.S. Pat. No. 3,893,869 issued to A. Mayer and S. Shwartzman on July 8, 1975, and assigned to RCA Corporation), hot-air drying offers many advantages over spin drying and in particular permits the cleaning and drying operation to be carried out in the same carrier as the subsequent thermal treatment, such as oxidation, diffusion, or annealing. One of the advantages of hot-air drying, in comparison with centrifuging, is that the liquid is not evenly spread over the surface of the wafers. Thus, if streaks are visible, it is immediately clear that the water supply is dirty and needs attention; conversely, if the water used in rinsing is clean, no streaks develop. This self-indicating feature is most valuable in detecting a problem long before device electrical tests would show that it exists. The best utilization achieved so far is the drying within five minutes of the contents of two carriers, one stacked over the other and each holding twenty-five wafers. Conceivably, the number of wafers could be doubled by closer spacing, but even so hot-air drying would require about 5 Wh/wafer plus the cost of the high-velocity air.

The present invention comprises a novel gas drying system designed to reduce the cost of cleaning silicon wafers, which would be an important step in making the production of silicon solar cells more economical. The invention to be described shows that it is unnecessary to heat the gas stream and that drying can be achieved in the same time of 0.5 to 2 minutes with roughly the same gas flow of 200 to 800 cubic feet per minute depending on the carrier geometry, for 3 inch (7.62 cm) diameter wafers.

SUMMARY OF THE INVENTION

The present invention is a gas drying system for use in removing a liquid from a substrate comprising a carrier adapted to support the substrate wherein the parts of the carrier that make contact with the substrate have a surface wettable by the liquid, and means for exposing the substrate to a stream of ambient-temperature gas.

DETAILED DESCRIPTION OF THE INVENTION

Figure 1:
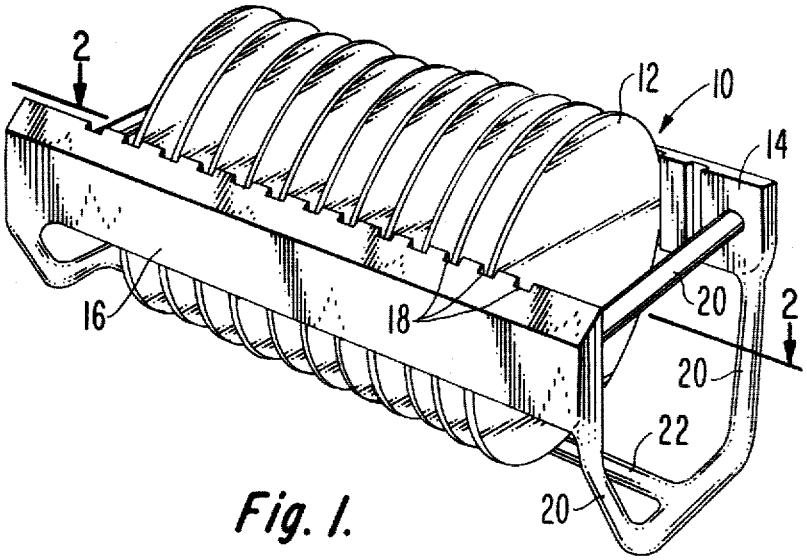
FIG. 1 is a perspective view showing one embodiment of the present novel wafer carrier.

In FIG. 1 of the drawing, there is shown one embodiment of a wafer carrier 10 adapted to support a plurality of semiconductor substrates 12 while being exposed to a liquid during processing. In the present example, the carrier 10 includes a pair of spaced-apart sidewalls 14 and 16 having grooves 18 therein adapted to make supporting contact with the substrates 12. The sidewalls 14 and 16 are coupled together by connecting means, typically rod-shaped structural members 20, to form channels for supporting the substrates 12. In addition to the grooves 18, the carrier has a base support rod 22 disposed longitudinally along the center line of the carrier 10.

I have discovered that the substrates 12 can be effectively dried with a stream of room-temperature gas by physical displacement of the surface liquid and evaporation of the few surface layers of absorbed liquid. This implies that drop formation should be avoided, i.e., that the surface energy of the liquid should be smaller than that of the substrates 12 so that the drops can spread and thereby wet the surface. The principle of the present invention is to make use of surface energy in spreading the last drops that are usually caught at the contact points between the substrates 12 and carrier 10, located along the support rod 22 and within the grooves 18. This is achieved in the present invention by having a wettable surface for the parts of the carrier 10 that make contact with the substrates 12, i.e., a surface that allows the liquid drops thereon to spread and thereby "wet" the carrier surface.

In processing the semiconductor substrates 12, the substrates 12 may be megasonically cleaned in a cleaning solution while being supported in the wafer carrier 10. In my experiments, I utilized an aqueous cleaning solution containing the hydroxyl ion ($OH^-$). In particular, RCA Corporation's SC-1 solution has worked extremely well, consisting of about 5 parts water, about 1 part of 30 percent hydrogen peroxide solution, and about 1 part of 30 percent ammonium hydroxide solution by volume. I found that wafers cleaned in solutions, such as SC-1, that leave the surface hydrophylic enable the water disposed on the open surface to be driven off rapidly and uniformly in an ambient-temperature air stream having a velocity of at least 12 meters per second (27 mph). The transfer of the last drops disposed at the contact points between the carrier 10 and substrates 12 is achieved by having a surface wettable by the water for at least those parts of the carrier 10 that make contact with the substrates 12, so that the surface energy of that surface permits the drops to spread.

In the present invention the wettable surface comprises a roughened surface of a material that is capable of being hydroxylated, i.e., a strong propensity for the hydroxyl (—OH) group. In my experiments I discovered that wafer carriers made from the following materials, or combinations thereof, work well by making the surface thereof extremely wettable to water: satin-surface quartz, polysulfone $[(R_2SO_2)_n]$, glass, and polyphenyl sulfide $[((C_6H_5)_2S)_n]$. It is emphasized that the required wettable surface is not obtained from the standard fire-polished quartz, presently utilized in semiconductor processing, but only from satin-surface quartz, which is quartz roughened by sand or shot blasting to obtain a "satin" surface finish. The polyphenyl sulfide which I used was the plastic Ryton, made by Phillips Petroleum Company, Chemicals Division, Bartelsville, OK. Similar considerations hold for solvents other than water, i.e., the best way to remove these with an ambient-temperature gas stream is by choosing a material capable of being wetted by the solvent.

Figure 2:
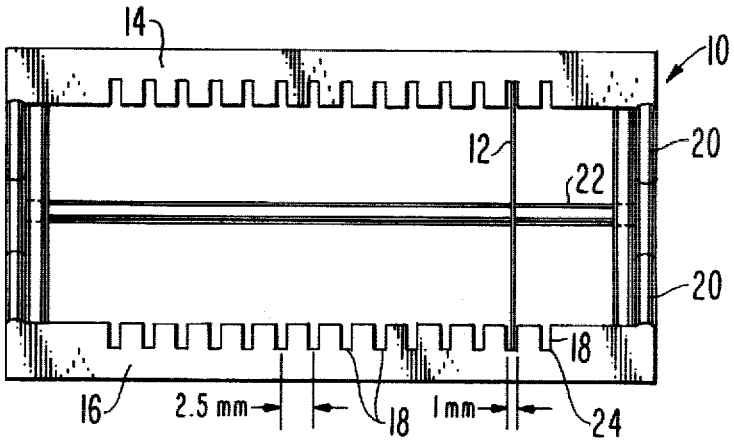
FIG. 2 is a cross-sectional view taken along line 2—2 of FIG. 1.

In my experiments, the first wafer carriers tried were fabricated from satin-surface quartz and had standard V-shaped grooves wherein the width at the tips thereof was about 0.5 mm (~20 mils), which resulted in an ambient-air drying time of over 5 minutes due to capillary trapping of the liquid. In order to further reduce the drying time required. I modified the groove design to make the grooves 18 U-shaped such that the width at the end thereof is at least 3 times the thickness of the substrates 12 being dried. Since a typical silicon wafer thickness is about 0.3 mm (~12 mils), I utilized U-shaped grooves 18 wherein the width at the ends 24 thereof was about 1 mm (~40 mils), as shown in FIG. 2. Comparison tests have shown that, in addition to the necessary wettable surface for the carrier 10, the clearance between the substrate 12 and the wall of the groove 18 at the end 24 thereof is very important in achieving efficient cold-air drying.

In order to achieve a desired target drying rate of 2500 wafers per hour, I also modified the spacing of the grooves 18 to double the number of substrates 12 per unit length, by reducing the spacing between consecutive grooves from the typical 5 mm (~3/16 inch) spacing down to about 2.5 mm (~3/32 inch), as shown in FIG. 2. However, in order to achieve rapid drying when the substrates 12 are only 2.5 mm apart in the carrier 10, it is essential for them to be separated from each other and not leaning toward each other. Otherwise, the air stream is cut off and wet spots remain for a relatively long time.

Figure 3:
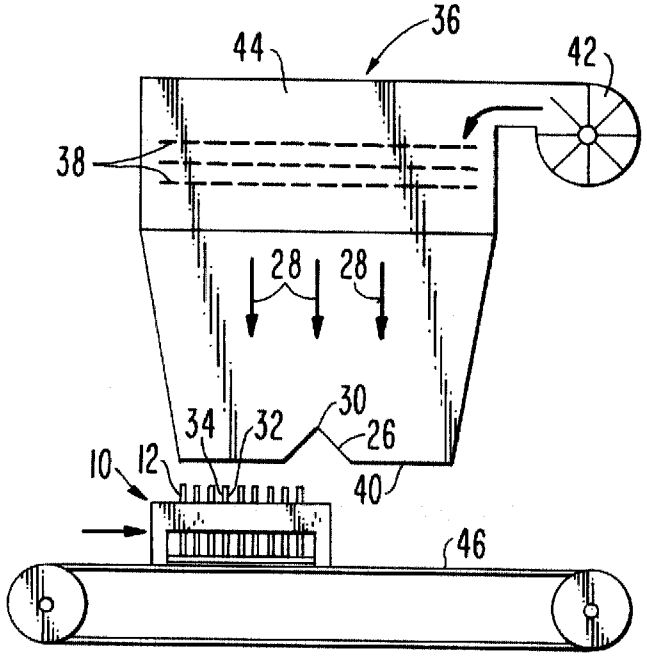
FIG. 3 is a diagrammatic side view illustrating one embodiment of the present novel gas drying system.

In order to avoid this problem, I utilized a method wherein the drying step is performed by first directing a stream of air toward one surface of the substrate, and then directing a stream of air toward the surface opposite the one surface, whereby the substrate is caused to change position with respect to the carrier. One embodiment of a gas drying system utilized to perform this technique is shown in FIG. 3. I inserted a roof-shaped deflector 26 between the source of the air stream and the substrates 12, as illustrated in FIG. 3. By moving the carrier 10 beneath the deflector 26 along a path orthogonal to both the gas stream, shown by arrows 28, and the peak 30 of the deflector 26, the gas stream is directed first toward the front surface 32 of each substrate 12 and is then directed toward the back surface 34 of each substrate 12, thereby causing the substrates 12 at one end of the carrier 10 to all lean in the same direction and not toward each other. Although only one embodiment for achieving this effect is shown, i.e., roof-shaped deflector plates, other directing means could be utilized, such as by using two separate oppositely-inclined deflector plates or by delivering a plurality of air streams from separately positioned nozzles aimed toward the edges of the substrates 12.

The concept of the present invention is to enable the wafers 12 to dry in the same carrier 10 utilized during the cleaning step in an economical manner wherein a drying rate of at least 2500 wafers per hour is achieved at relatively low energy consumption. The essence of the present novel system comprises a carrier 10 adapted to support the substrates 12 wherein the parts of the carrier 10 that make contact with the substrates 12 have a wettable surface, in cooperation with means for exposing the supported substrates 12 to a stream of ambient-temperature gas. In FIG. 3, there is shown the novel gas drying system wherein an air drier 36 takes in ambient-temperature air, filters it through a large HEPA (high efficiency particulate air) filter 38 rated 99.97% efficient for particles down to 0.3$\mu$m in diameter, and then delivers it toward the substrates 12 with a velocity of more than approximately 12 meters per second (27 mph) through a rectangular bottom opening 40 that is wide enough for one and long enough for two carriers 10. In my experiments, the drier 36 consisted of a $\frac{3}{4}$-HP squirrel cage fan 42 which delivered room temperature air through the HEPA filter 38 located underneath a plenum chamber 44. In actual tests, the air velocity was measured with a Peto gage and found to be about 25±2.5 m/s without a load. Although air is utilized as the drying gas in the present embodiment, any other type of gas may be used, such as commercial nitrogen gas.

The means for moving the carrier 10 beneath the opening 40 comprises a motor-driven conveyor belt 46 in the present embodiment. Such a conveyor system may be designed so that it connects the megasonic cleaning system, via the dryer 36, to an inspection station.

Figure 4:
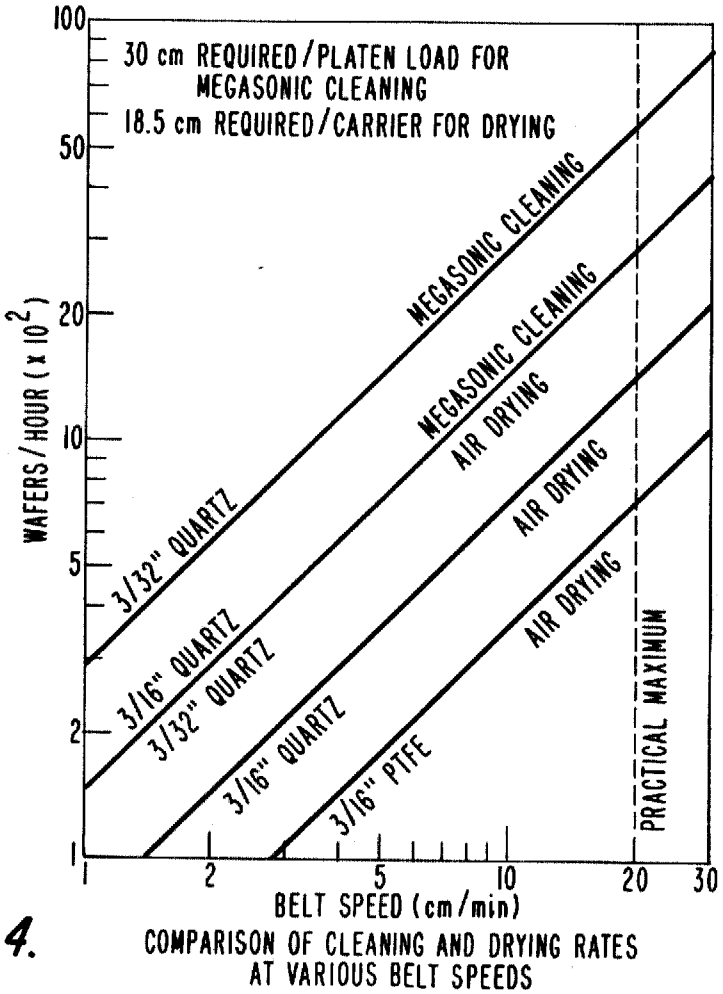
FIG. 4 is a graph showing a comparison of cleaning and drying rates at various belt speeds.

I have performed drying tests as various belt speeds utilizing the novel satin-surface quartz carriers with U-shaped groove spacings of both 0.5 mm (~3/16 inch) and 2.5 mm (~3/32 inch) for holding 25 and 50 wafers, respectively. Complete dryness was achieved in such carriers at belt speeds up to about 18 cm/min. Above that speed one or two wafers per carrier had wet spots, usually at the edge. As can be seen from FIG. 4, this belt speed corresponds to a drying rate of about 2600 wafers per hour in the 2.5 mm (~3/32 inch) spaced grooves. FIG. 4 also shows corresponding megasonic cleaning rates. Whereas the cleaning rates are a function of only the wafer spacing, the drying rates are also affected by the nature of the carrier. For comparison purposes, wafers in standard PTFE (polytetrafloroethylene) carriers generally dry at about half the maximum rate achievable in satin-surface quartz carriers.

The novel air drying system will make it possible to achieve throughput rates of 2500 wafers/hour when operating the megasonic unit and the rinse tank together with the ambient-temperature air dryer 36. Such a system provides an important processing step applicable not only to the economical production of solar cells, but also to the production of other wafers destined to make integrated circuit devices.

What is claimed is:

1. In a wafer carrier adapted to support a semiconductor substrate while being exposed to a liquid during processing, the improvement in said carrier comprising the parts thereof that make contact with said substrate having a surface wettable by said liquid and said wettable surface having a roughened surface of a material that is capable of being hydroxylated.

2. A water carrier as defined in claim 1 wherein said material is selected from the group consisting of satin-surface quartz, polysulfone $[(R_2SO_2)_n]$, glass, polyphenyl sulfide $[((C_6H_5)_2S)_n]$, and combinations thereof.

3. A wafer carrier as defined in claim 1 including a pair of spaced-apart sidewalls having grooves therein adapted to make supporting contact with said substrate, said sidewalls being coupled together by connecting means such that corresponding pairs of consecutive grooves face each other to form channels for supporting a plurality of said substrates, a further improvement comprising each of said grooves being U-shaped such that the width at the end thereof is at least three times the thickness of said substrate.

4. A wafer carrier as defined in claim 3 wherein the width at the end of said U-shaped grooves is about 1 millimeter and wherein the spacing between consecutive groove is about 2.5 millimeters.

5. In a method of processing a semiconductor substrate including the steps of cleaning said substrate in a cleaning solution while being supported in a wafer carrier and drying said substrate after removal from said cleaning solution, the improvement in said method comprising performing said drying step in the same wafer carrier utilized during said cleaning step, wherein the parts of said carrier that make contact with said substrate have a surface wettable by said cleaning solution and said wettable surface comprises a roughened surface of a material that is capable of being hydroxylated.

6. A method as recited in claim 5 wherein said drying step is performed by exposing said substrate to a stream of ambient-temperature gas.

7. The method as recited in claim 6 wherein said drying step is performed by first directing a stream of the gas toward one surface of said substrate, and then directing a stream of the gas toward the surface opposite said one surface, whereby said substrate is caused to change position with respect to said carrier.

8. A method as recited in claim 7 wherein said directing steps are performed by inserting a roof-shaped deflector between the source of said gas stream and said substrate, and moving said carrier beneath said deflector along a path orthogonal to both said gas stream source and the peak of said deflector, said one and said opposite surfaces of said substrate being supported substantially orthogonal to said path.

9. A method as recited in claim 5 wherein said material is selected from the group consisting of satin-surface quartz, polysulfone $[(R_2SO_2)n]$, glass, polyphenyl sulfide $[((C_6H_5)_2S)_n]$, and combinations thereof.

10. A method as recited in claim 5 wherein said wafer carrier includes a pair of spaced-apart sidewalls having grooves therein adapted to make supporting contact with said substrate, said sidewalls being coupled together by connecting means such that corresponding pairs of consecutive grooves face each other to form channels for supporting a plurality of said substrates, a further improvement comprising each of said grooves being U-shaped such that the width at the end thereof is at least three times the thickness of said substrate.

11. A method as recited in claim 10 wherein the width at the end of said U-shaped grooves is about 1 millimeter and wherein the space between said grooves is about 2.5 millimeters.

12. A method as recited in claim 5 wherein said cleaning solution comprises an aqueous solution containing the hydroxyl ion ($OH^-$).

13. A method a recited in claim 12 wherein said aqueous solution consists of about 5 parts water, about 1 part of 30 percent hydrogen peroxide solution, and about 1 part of 30 percent ammonium hydroxide solution by volume.

14. A gas drying system for use in removing a liquid from a substrate comprising:

a carrier adapted to support said substrate wherein the parts of said carrier that make contact with said substrate have a surface wettable by said liquid said wettable surface comprises a roughened surface of a material that is capable of being hydroxylated, and means for exposing said substrate, while supported in said carrier, to a stream of ambient-temperature gas.

15. A gas drying system as defined in claim 14 wherein said material is selected from the group consisting of satin-surface quartz, polysulfone $[(R_2SO_2)_n]$, glass, polyphenyl sulfide $[((C_6H_5)_2S)_n]$, and combinations thereof.

16. A gas drying system as defined in claim 14 wherein said carrier includes a pair of spaced-apart sidewalls having grooves therein adapted to make supporting contact with said substrate, said sidewalls being coupled together by connecting means such that corresponding pairs of consecutive grooves face each other to form channels for supporting a plurality of said substrates, a further improvement comprising each of said grooves being U-shaped such that the width at the end thereof is at least three times the thickness of said substrate.

17. A gas drying system as defined in claim 16 wherein the width at the end of said U-shaped grooves is about 1 millimeter and wherein the space between said grooves is about 2.5 millimeters.

18. A gas drying system as defined in claim 14 further comprising means for directing the stream of gas first toward one surface of said substrate and then toward the surface opposite said one surface.

19. A gas drying system as defined in claim 18 wherein said directing means comprises a roof-shaped deflector disposed between the source of said air stream and said substrate, and means for moving said carrier beneath said deflector along a path orthogonal to both said air stream source and the peak of said deflector, said one and said opposite surfaces of said substrate being supported substantially orthogonal to said path.

20. A gas drying system as defined in claim 19 wherein said gas comprises ambient air and wherein said moving means comprises a motor-driven conveyor belt.

* * * * *